US008327929B2

(12) United States Patent
Reid et al.

(10) Patent No.: US 8,327,929 B2
(45) Date of Patent: Dec. 11, 2012

(54) SUPPORT ASSEMBLY FOR DOWNHOLE TOOL, DOWNHOLE TOOL AND METHOD

(75) Inventors: Michael A. Reid, Aberdeen (GB); William S. Burnett, Aberdeen (GB)

(73) Assignee: Red Spider Technology Limited, Westhill, Aberdeen (GB)

( * ) Notice: Subject to any disclaimer, the term of this patent is extended or adjusted under 35 U.S.C. 154(b) by 451 days.

(21) Appl. No.: 12/218,599

(22) Filed: Jul. 16, 2008

(65) Prior Publication Data

US 2009/0065191 A1 Mar. 12, 2009

(30) Foreign Application Priority Data

Jul. 18, 2007 (GB) ..... 0713919.9

(51) Int. Cl.
*E21B 33/12* (2006.01)
*E21B 23/06* (2006.01)

(52) U.S. Cl. ..... 166/138; 166/196; 166/387

(58) Field of Classification Search ..... 166/138, 166/118, 387, 196
See application file for complete search history.

(56) References Cited

U.S. PATENT DOCUMENTS 3,554,280 A 1/1971 Tucker
4,745,972 A * 5/1988 Bell et al. ..... 277/338
5,676,384 A 10/1997 Culpepper
6,666,275 B2 12/2003 Neal et al.
6,695,051 B2 * 2/2004 Smith et al. ..... 166/134
6,769,491 B2 * 8/2004 Zimmerman et al. ..... 166/387
2003/0226660 A1 * 12/2003 Winslow et al. ..... 166/118
2006/0005963 A1 1/2006 Hiorth et al.
2010/0186970 A1 * 7/2010 Burnett et al. ..... 166/387

FOREIGN PATENT DOCUMENTS

GB 2308138 6/1997
WO WO-03058026 7/2003
WO WO-2007119052 10/2007

OTHER PUBLICATIONS

The UK Search Report dated Aug. 13, 2008.
Mesquite Oil Tools, Inc. product sheet(s).

* cited by examiner

*Primary Examiner* — Kenneth L Thompson
(74) *Attorney, Agent, or Firm* — Ladas & Parry LLP

(57) ABSTRACT

A support assembly for a deformable sealing element of a downhole tool such as a packer, bridge plug or straddle. The support assembly has first and second support devices at each end of the sealing element with each device having an elastically deformable support member adapted to be located between the respective end of the sealing element and an actuating member of the downhole tool. Additionally, a guide member with an inclined guide surface is provided such that the support member travels along the inclined surface when a force is exerted by the actuating member to expand the sealing element radially into abutment with a surface downhole. The support member moves radially outwards to support the respective end of the sealing element during deformation.

19 Claims, 7 Drawing Sheets

SUPPORT ASSEMBLY FOR DOWNHOLE TOOL, DOWNHOLE TOOL AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

The present invention relates to a support assembly for a deformable sealing element of a downhole tool, a downhole tool having a deformable sealing element, and to a method of supporting a deformable sealing element of a downhole tool. In particular, but not exclusively, the present invention relates to a support assembly for a deformable sealing element of a downhole tool such as a packer or a bridge plug.

(2) Description of Related Art including information disclosed under 37 CFR 1.97 and 1.98

As is well known in the oil and gas exploration and production industry, a wellbore is drilled from surface in order to gain access to subterranean hydrocarbon deposits (oil and gas). The wellbore is typically drilled to a first depth and then lined with a steel casing which is cemented in place, both to support the drilled rock formations, and to prevent unwanted fluid ingress/egress. The wellbore is then extended to a further depth and a smaller diameter casing is located in the extended section, passing through the wellbore to surface, and which is also cemented in place. This process is repeated as necessary until the wellbore has been extended to a desired depth. If required, a liner may be located in the final drilled section, the liner tied in to the deepest section of casing in the wellbore. The well is then completed, which involves carrying out various downhole procedures so that well fluids can be recovered to surface through production tubing located in the cased wellbore.

During the drilling and completion of a wellbore, it is frequently necessary to isolate and thus seal-off a portion of the wellbore. For example, the production tubing is typically located within and sealed relative to the casing/liner using a 'packer'. Packers are also used in other downhole procedures, including intervention operations, where a remedial action is to be carried out downhole. Packers typically include a deformable sealing element which, when the packer is activated, are compressed axially, urging the sealing element radially outwardly into sealing abutment with an inner wall of the casing/liner.

Other types of downhole tools include similar deformable sealing elements. Typical such tools include 'bridge plugs' used to isolate part of a wellbore, and 'straddles' which may be required in circumstances where a tubing has corroded, leading to unwanted fluid ingress/egress. Where a tubing has corroded, a straddle including a pair of spaced deformable sealing elements is run downhole to straddle across the corroded section. A first such element is located uphole of the corroded section, and a second such sealing element downhole of the corroded section. In this fashion, when the straddle is activated, the sealing elements are both urged outwardly into sealing engagement with the inner wall of the tubing, to bridge across and isolate the corroded section, thereby preventing further unwanted fluid ingress/egress.

Typically, the deformable sealing elements of tools such as packers, bridge plugs, straddles and the like are of an elastomeric material which, when compressed axially, deform radially outwardly into abutment with the respective downhole tubing. If or when it is desired to remove the tools from the wellbore, the tool is actuated to release an applied compressive axial loading, moving the sealing element out of abutment with the tubing in question, so that the tool may be returned to surface.

However, loads applied to the sealing element when it is compressed and urged into abutment with the tubing can cause a permanent deformation of the sealing element, making it difficult to retract the element from abutment with the tubing, thereby hampering return of the tool to surface. Furthermore, the loads applied to the sealing elements can result in the sealing element extruding axially along the wellbore, reducing the sealing effect and potentially leading to seal failure.

In an effort to address these problems and deficiencies, it has become common practice to incorporate 'garter' springs into axial ends of the sealing elements. The garter springs offer a greater resistance to deformation than a main portion of the sealing element, to thereby support the ends of the sealing element, with the aim of preventing axial extrusion of the sealing element along the wellbore. Furthermore, the springs are configured so as to elastically recover following removal of a deformation load, in an effort to assist retraction of the sealing element from abutment with the tubing.

Garter springs typically comprise an outer coil spring wound in a first direction, and an inner coil spring wound in the opposite direction and located within the outer coil spring. The garter springs are typically moulded into annular elastomeric sections of a harder, less compressible material than a main portion of the sealing element, which are bonded to the main portion. Moulding the garter springs into these annular sections, and bonding of the annular sections to the main portions, presents certain manufacturing difficulties.

Furthermore, the inner and outer coil springs are typically wound in opposite directions in an effort to prevent interengagement of coils of the springs following deformation of the sealing element, and the ingress of elastomeric material into the springs. However, it has been found that, in use and following deformation of the sealing element, the outer and inner coil springs nonetheless tend to become interengaged, and elastomeric material tends to penetrate the coils. This results in the garter springs becoming permanently deformed such that, when a deformation load applied to the sealing element is removed, the garter springs do not completely retract to their undeformed positions. This ultimately leads to a permanent deformation of the sealing element and the problems highlighted above. Also, this permanent deformation requires complete replacement of the sealing element before the tool can be reused.

It is amongst the objects of at least one embodiment of the present invention to obviate or mitigate at least one of the foregoing disadvantages.

BRIEF SUMMARY OF THE INVENTION

According to a first aspect of the present invention, there is provided a support assembly for a deformable sealing element of a downhole tool, the support assembly comprising:

a first support device adapted to be located adjacent a first end of a deformable sealing element of a downhole tool; and a second support device adapted to be located adjacent a second end of the sealing element;

wherein the first and second support devices each comprise at least one elastically deformable support member adapted to be located between the respective end of the sealing element and an actuating member of the downhole tool; and a guide member having an inclined guide surface along which the support member travels when a force is exerted on the sealing element by the respective actuating member to expand the sealing element radially into abutment with a surface downhole, the guide member acting to move the support member radially outwardly to thereby support the respective end of the sealing element during deformation.

By providing a support assembly in which the deformable sealing element is supported in this fashion, a tendency of the sealing element to extrude axially relative to the downhole tool is reduced.

Furthermore, by providing a support assembly in which the support member is provided separately from the sealing element, problems experienced with prior sealing elements where garter springs have a tendency to become permanently deformed (leading to a permanent deformation of the sealing element) are reduced or even avoided.

Additionally, by providing a support assembly in which the support member is elastically deformable and travels along the guide member during exertion of deformation loads on the sealing element, when the deformation load is removed, the support member tends to return radially inwardly. This avoids or reduces the likelihood of the sealing element becoming permanently deformed. It will therefore be understood that the support member may be adapted to travel back along the inclined guide surface of the guide member when the force acting on the sealing element is removed, so that the support member returns radially inwardly. Thus the inherent elasticity of the support member may cause an elastic recovery of the support member when the deformation load is removed.

The support members may each be expandable on exertion of the force on the sealing element, such that an at least one dimension of the support devices increases. The support members may be movable between a retracted position, and an extended position in which the support members support the sealing element, on exertion of the force on the sealing element. The support members may be adapted to return to their retracted positions on removal of the deformation force applied to the sealing element.

The support devices may each further comprise an elastically deformable force transmission element for the respective support member, the support member adapted to be located in abutment with the force transmission element, and the force transmission element adapted to be located in sliding contact/abutment with the inclined guide surface of the respective guide member. Accordingly, the support members may be located on/in contact with the force transmission elements, and the force transmission elements may be located on/in contact with the respective inclined guide surfaces, so that the support members travel along the inclined guide surfaces by sliding contact/abutment between the force transmission elements and the inclined guide surfaces. The force transmission elements may each comprise abutment surfaces for abutment with the support member, and inclined surfaces adapted to cooperate with the inclined guide surfaces of the guide members, to facilitate passage of the support members along and thus relative to the guide member.

Alternatively, the support members are each adapted to be located in sliding contact/abutment with the guide surfaces of the respective guide members, and may comprise inclined surfaces adapted to cooperate with the inclined guide surfaces of the guide members, to facilitate passage of the support members along and thus relative to the guide members.

The support members of each support device may be adapted to extend radially on exertion of an expansion force on the sealing element, to thereby support the sealing element. The support members may be generally annular members having inner and outer surfaces describing respective inner and outer diameters of the support members, and the support members may be configured such that cooperation with the respective guide members (on exertion of the force on the sealing element) results in an increase in both the inner and outer diameters of the support members. When the expansion load is removed, the support members may return fully or at least substantially to an undeformed state, wherein the inner and outer diameters of the support members are the same as or substantially similar to the respective diameters prior to exertion of the force.

The support members may each take the form of a spring or a sprung member, and may comprise a plurality of slots, channels or the like extending through a wall thereof. The slots may extend through the support members in an axial direction (relative to the downhole tool) and part way along the support member in a radial direction (relative to the downhole tool). The slots may be configured such that at least one dimension of the slots increases on exertion of the force on the sealing element, to facilitate the radial movement of the support member to thereby support the sealing element.

Where the support devices comprise elastically deformable force transmission elements, the force transmission elements may be adapted to extend radially on exertion of an expansion force on the sealing element, to thereby carry the support members radially outwardly. The force transmission elements may be generally annular members having inner and outer surfaces describing respective inner and outer diameters of the force transmission elements, and the force transmission elements may be configured such that cooperation with the respective guide members (on exertion of the force on the sealing element) results in an increase in both the inner and outer diameters of the force transmission elements. When the expansion force is removed, the force transmission elements may return fully or at least substantially to an undeformed state, wherein the inner and outer diameters of the force transmission elements are the same as or substantially similar to the respective diameters prior to exertion of the expansion force.

The force transmission elements may each take the form of a spring or a sprung member, and may comprise a plurality of slots, channels or the like extending through a wall thereof. The slots may extend through the force transmission elements in a radial direction (relative to the downhole tool) and part way along the support member in an axial direction (relative to the downhole tool). The slots may be configured such that at least one dimension of the slots increases on exertion of the force on the sealing element, to facilitate the radial movement of the force transmission elements to carry the support members radially outwardly.

At least one or both of the support devices may comprise a plurality of support members located in abutment and provided between the respective ends of the sealing element and the respective actuating members. This may offer advantages in terms of ease of manufacture, where the support members include slots (which may be formed by cutting or milling), by reducing a required depth of cut and still providing effective support for the sealing element. Furthermore, providing such a plurality of support members offers advantages in that the support members can be located so the slots in one support member are circumferentially spaced relative to the slots in an adjacent support member. This may enable a distribution of forces in adjacent support members when the expansion force is exerted on the sealing element, and may reduce a likelihood of a foreign object from entering and potentially jamming the support devices.

In a particular embodiment, at least one or both of the support devices comprises a pair of support members, a first support member being located in abutment with the actuating member and a second support member, and the second support member being located in abutment with the first support member and the sealing element. Where the support devices optionally include further support members, the further support members may be located between the support members which are located in abutment with the sealing element and the actuating member, respectively.

An at least one support member of the support devices may comprise an inclined abutment surface for facilitating movement of the support member radially inwardly and thus retraction of the sealing element from abutment with the downhole surface. The inclined abutment surface may facilitate retraction of the sealing element, in the unlikely event that the sealing element becomes stuck in an expanded position, by interaction with a downhole formation such as a shoulder, edge or other surface of a downhole component.

References herein to the support members travelling along the inclined guide surface include the support members being in direct abutment with and thus in sliding contact with the guide surface, as well as the support members being mounted via an intermediate member such as the force transmission elements, so that the support members move relative to the surface.

Furthermore, references herein to the guide surfaces of the guide members being inclined (as well as references to other inclined surfaces) are to the guide surfaces being inclined relative to a main axis of the downhole tool on which the sealing element is mounted.

According to a second aspect of the present invention, there is provided a downhole tool comprising:

a deformable sealing element adapted to be expanded radially into abutment with a surface downhole;

a first actuating member located adjacent a first end of the sealing element;

a second actuating member located adjacent a second end of the sealing element;

a first support device located adjacent the first end of the sealing element; and a second support device located adjacent the second end of the sealing element;

wherein the first and second support devices each comprise at least one elastically deformable support member located between the respective end of the sealing element and the respective actuating member; and a guide member having an inclined guide surface along which the support member travels when a force is exerted on the sealing element by the respective actuating member to expand the sealing element, the guide member acting to move the support member radially outwardly to thereby support the respective end of the sealing element during deformation.

Further features of the first and second support devices of the downhole tool are defined above in relation to the first aspect of the present invention.

The actuating members may each comprise an abutment surface on an end thereof, the abutment surface adapted to abut a respective support member to facilitate transmission of an expansion force on the sealing element. The actuating members may also each comprise a recess or cutaway in the ends thereof, at least part of the recess located radially inwardly of the abutment surface, the recess adapted to receive the guide member when the actuating member exerts the expansion force on the sealing element.

Where the support devices comprise elastically deformable force transmission elements for the respective support member with the support member located in abutment with the force transmission element, the recess may also be adapted to receive the force transmission element. The actuating member may further comprise a second abutment surface, the second abutment surface adapted to abut a respective force transmission element, to facilitate transmission of a radial force on the support member through the force transmission element. Accordingly, the actuating members may simultaneously exert an axial force on the support member, to compress the sealing element, and an axial force on the force transmission elements to cause them to urge the support members radially outwardly.

At least one, optionally both of the actuating members may be mounted for movement relative to a main body of the tool, for exerting an expansion force on the sealing element. The actuating members may be annular members and may take the form of pistons and thus may be fluid actuated, or may be mechanically or electro-mechanically actuated members.

The first and second ends of the sealing element may comprise abutment surfaces adapted to abut the respective support members, to facilitate transmission of an expansion force on the sealing element. The sealing elements may also each comprise a recess or cutaway in the ends thereof, at least part of the recess located radially inwardly of the abutment surface, the recess adapted to receive the guide member. This may facilitate abutment of the sealing element with the support members, for transmission of an expansion force on the sealing element, whilst permitting direct (or indirect) contact of the support members with the guide member for movement radially outwardly.

In embodiments of the invention, the downhole tool may be a packer, a bridge plug or a straddle. However, it will be understood that the principles of the present invention are applicable to a wide range of types of downhole tool requiring or incorporating a deformable sealing element. Indeed, the present invention has a potential utility outwith the field of downhole tools, and thus in further aspects of the invention, alternative tools may be provided having the features of the downhole tool defined above. For example, tools to be used in pipelines or other flowlines may be provided having the features of the downhole tool defined above.

According to a third aspect of the present invention, there is provided an elastically deformable support member for a support device of a downhole tool adapted to support a sealing element during deformation, the support member adapted to be located between an end of a sealing element on a downhole tool and an actuating member of the tool and being adapted to travel along an inclined guide surface of a guide member of the support device when a force is exerted on the sealing element to expand the sealing element radially into abutment with a surface downhole, so that the support member moves radially outwardly to thereby support the end of the sealing element during deformation.

Further features of the elastically deformable support member are defined above in relation to the first aspect of the present invention.

According to a fourth aspect of the present invention, there is provided a method of supporting a deformable sealing element of a downhole tool during radial expansion into abutment with a surface downhole, the method comprising the steps of:

mounting a first support device adjacent a first end of a deformable sealing element on a downhole tool;

mounting a second support device adjacent a second end of the sealing element;

exerting a force on the sealing element using a first actuating member located adjacent the first end of the sealing element and a second actuating element located adjacent the second end of the sealing element, to expand the sealing element into abutment with a surface downhole; and transmitting the force exerted on the sealing element by the first and second actuating members through respective first and second support devices located adjacent the respective first and second ends of the sealing element, to cause elastically deformable support members of each support device to travel along inclined guide surfaces of respective guide members of the devices such that the support members move radially outwardly to thereby support the respective ends of the sealing element during deformation.

Embodiments of the present invention will now be described, by way of example only, with reference to the accompanying drawings, in which:

DETAILED DESCRIPTION OF THE INVENTION

Figure 1:
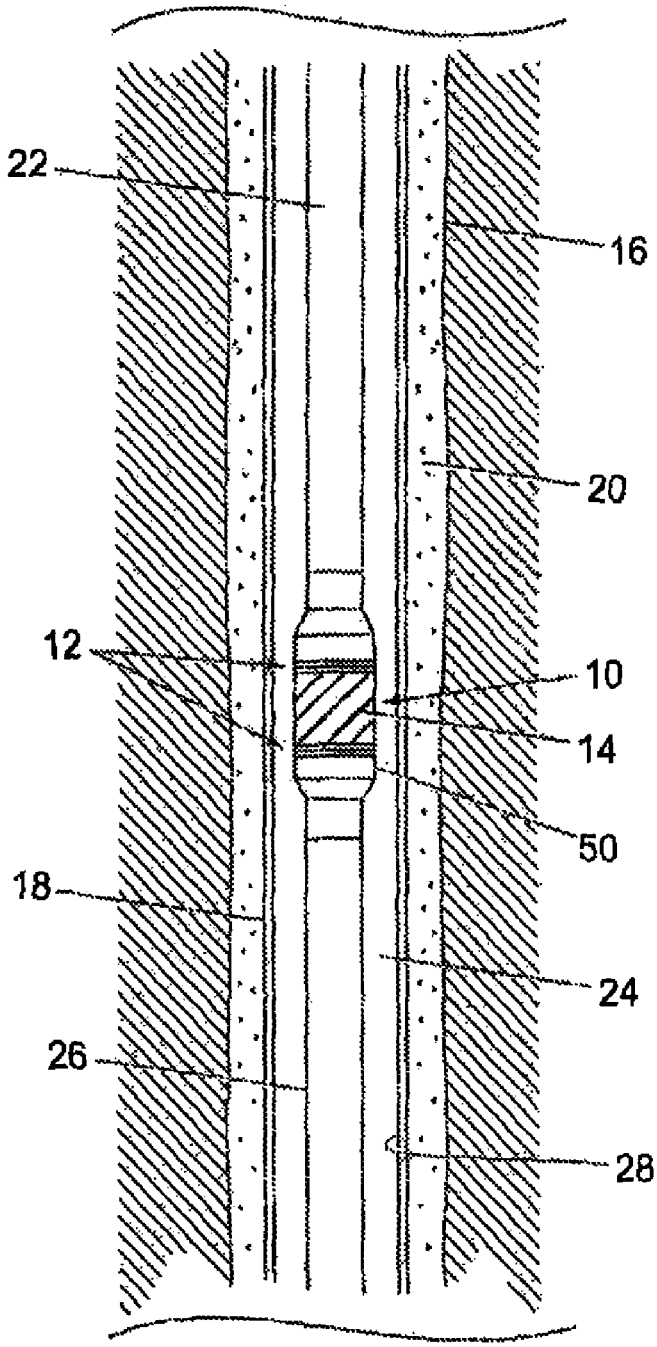
FIG. 1 is a schematic, partial longitudinal sectional view of a downhole tool in the form of a packer, the packer comprising a support assembly for a deformable sealing element, in accordance with an embodiment of the present invention, the packer shown prior to actuation.

Turning firstly to FIG. 1, there is shown a schematic, partial longitudinal sectional view of a downhole tool in the form of a packer 10, the packer 10 comprising a support assembly 12 for a deformable sealing element 14, in accordance with an embodiment of the present invention.

The packer 10 has been run-in to a wellbore 16 which has been drilled from surface to a desired depth and lined with a steel casing 18 that has been cemented in place using cement 20, in a fashion known in the art. The packer 10 is a production packer, provided as part of a string of production tubing 22 which has been run-in to the cased wellbore 16. The packer 10 is activated to seal off an annulus 24 defined between an outer surface 26 of the production tubing 22 below the packer 10 and an inner wall 28 of the casing 18. In this fashion, well fluids entering the casing 18 are directed up through the production tubing 22 to surface.

Figure 2:
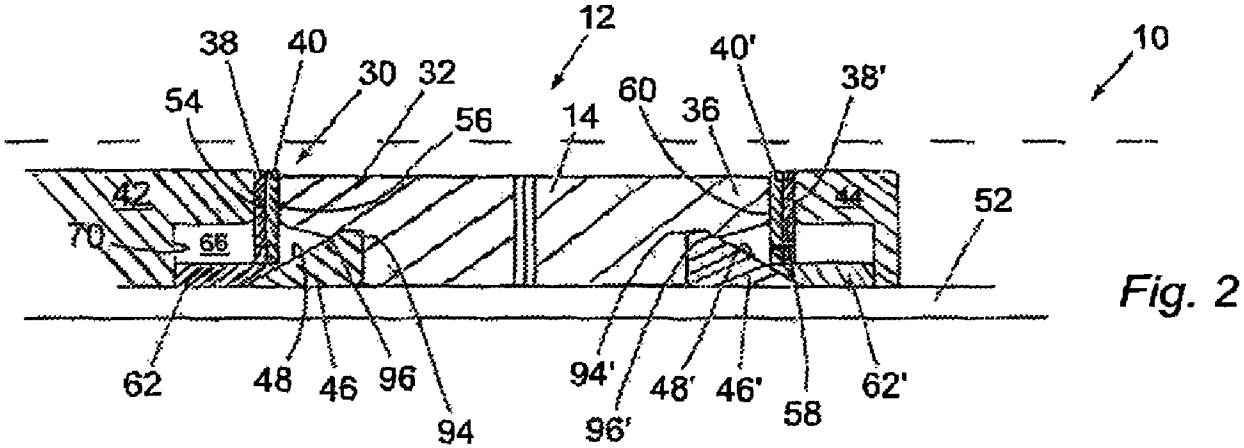
FIG. 2 is an enlarged, longitudinal half-sectional view of part of part of the packer shown in FIG. 1, illustrating the support assembly in more detail.

The support assembly 12 is shown in more detail in the enlarged, longitudinal half-sectional view of FIG. 2, and generally comprises a first support device 30 located adjacent a first end 32 of the sealing element 14, and a second support device 34 located adjacent a second end 36 of the sealing element 14. The first and second support devices 30 and 34 each comprise at least one elastically deformable support member and, in the illustrated embodiment, comprise two such support members 38, 40 and 38', 40', respectively. These support members 38, 40 and 38', 40' are located between the respective ends 32, 34 of the sealing element and actuating members 42, 44 on the packer 10.

The support assemblies 30, 34 also comprise respective guide members 46, 46' having inclined guide surfaces 48, 48', the support members 38, 40 and 38', 40' travelling along (relative to) the surfaces 48, 48' when a force is exerted on the sealing element 14 by the respective actuating members 42 and 44. As will be described in more detail below, a force is exerted on the sealing element 14 to expand the sealing element 14 radially into abutment with a surface downhole which, in the illustrated embodiment, is the casing inner wall 28. In use, the guide members 46, 46' act to move the support members 38, 40 and 38', 40' radially outwardly, to thereby support the respective ends 32 and 34 of the sealing element 14 during deformation. The sealing element 14 is shown following deformation and expansion into contact with the casing inner wall 28 in FIG. 3, which is a view similar to that of FIG. 2, and FIG. 4, which is a view similar to that of FIG. 1.

Figure 3:
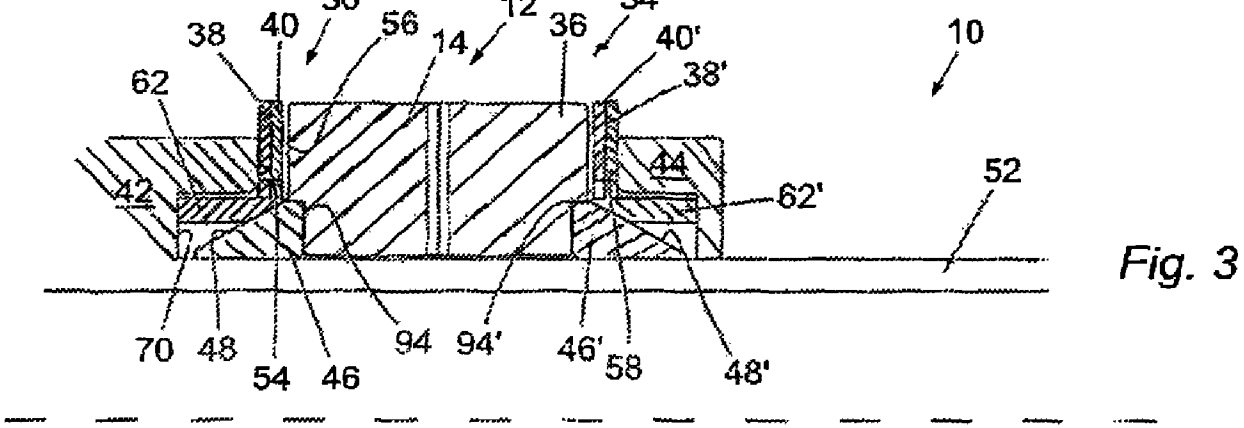
FIG. 3 is a view of part of the packer of FIG. 1, similar to the view of FIG. 2, but showing the support assembly following actuation of the packer.

As illustrated particularly in FIG. 3, during exertion of an expansion force on the sealing element 14, which compresses the sealing element to urge it radially outwardly, the support members 38, 40 and 38', 40' travel along the inclined guide surfaces 48, 48' and are thus carried radially outwardly. This maintains the support members 38, 40 and 38', 40' in positions where they support the axial ends 32 and 36 of the sealing element 14, thereby preventing extrusion of the sealing element along the wellbore 16 and thus holding the sealing element in a shape which provides a good sealing abutment with the casing inner wall 28.

Furthermore, as the support members 38, 40 and 38', 40' are elastically deformable, when the expansion force exerted on the sealing element 14 is removed, the support members 38, 40 and 38', 40' may return radially inwardly towards their starting positions shown in FIG. 2, by return travel along the inclined guide surfaces 48, 48'. The expansion force may be removed in the event that it is desired to pull the production tubing 22 from the wellbore 18, for example, to perform a workover operation or to shut-in the well. Following removal of the expansion force, and exertion of a pull force on the packer 10 (through the production tubing 22), elastic recovery of the support members 38, 40 and 38', 40' thus returns them inwardly so as not to define an upset on an outer surface 50 of the packer 10, which could otherwise hamper recovery of the production tubing 22 (for example, through contact between one of the support members 38, 40 and 38', 40' and a shoulder, ledge or the like uphole of the packer 10).

The structure and method of operation of the packer 10 and support assembly 12 will now be described in more detail.

The actuating member 42 takes the form of a sleeve which is movably mounted on a main mandrel 52 of the packer 10. In a fashion known in the art, the sleeve 42 is typically initially held against movement relative to the mandrel 52 by an arrangement of shear pins (not shown), to prevent premature setting of the packer 10. The actuating member 44 also takes the form of a sleeve, but is secured against movement relative to the mandrel 52. The production tubing 22, carrying the packer 10, is run into the casing 18 and set-down on the bottom of the wellbore 16. The packer 10 is then activated by setting weight down on the packer, which shears the pins holding the actuating sleeve 42 against movement relative to the mandrel 52. The sleeve 42 is then free to move downhole.

The support member 38 of the first support device 30 is located between and in abutment with a surface 54 of the actuating sleeve 42, and the second support member 40. In turn, the second support member 40 of the first support device 30 is located between and in abutment with the first support member 38, and a surface 56 of the end 32 of the sealing element 14.

In a similar fashion, the first support member 38' of the second support device 34 is located between and in abutment with a surface 58 of the fixed sleeve 44, and the second support member 40'. In turn, the second support member 40' of the second support device 34 is located between and in abutment with the first support member 38', and a surface 60 of the end 36 of the sealing element 14.

Figure 4:
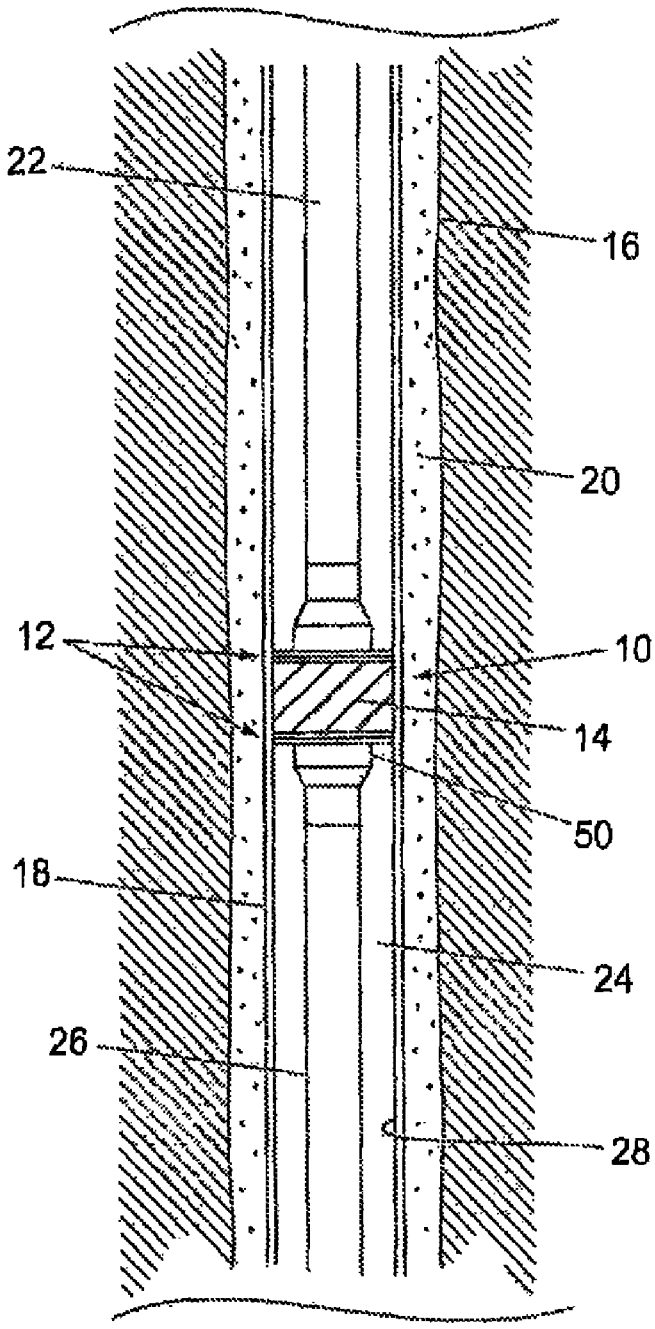
FIG. 4 is a view of the packer of FIG. 1, showing the packer following actuation.

Accordingly, when the actuating sleeve 42 is freed for movement relative to the mandrel 52, and weight is set down on the packer 10, an expansion force is transmitted to the sealing element 14 through the abutment surface 54 of sleeve 42, the first support member 38, and the second support member 40 acting on the surface 56 of the sealing element 14. Movement of the sealing element 14 downhole is resisted through abutment between the surface 60 of the sealing element 14, the second support member 40', and the first support member 38' acting on the surface 58 of the fixed sleeve 44. The axially directed force exerted on the sealing element 14 by the actuating sleeve 42 is thus resisted by the fixed sleeve 44. The sealing element, which is typically of an elastomeric material, is then compressed axially and, as a result, expands radially outwardly into sealing abutment with the casing wall 28, as shown in FIGS. 3 and 4.

Figure 6:
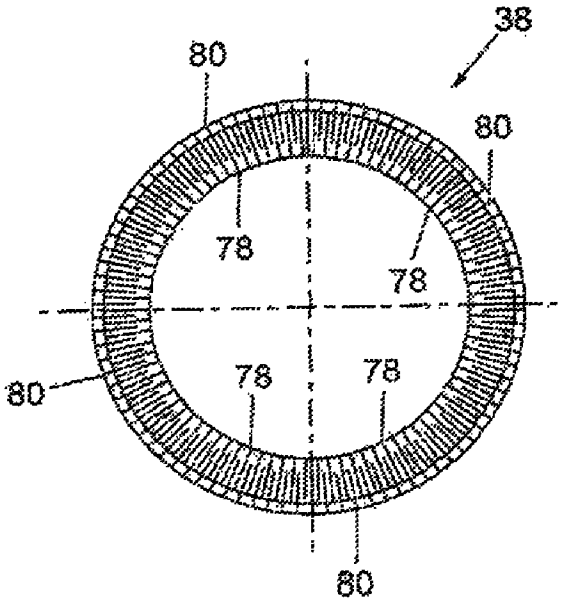
FIGS. 5 and 6 are enlarged cross-sectional side and end views, respectively, of a support member forming part of the support assembly of FIGS. 1 to 3.
Figure 5:
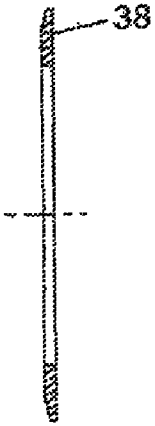

The support devices 30 and 34 also comprise force transmission elements in the form of elastically deformable annular elements 62 and 62', on which the support members 38, 40 and 38', 40' (respectively) are seated. The support member 38 is shown in more detail in the enlarged cross-sectional side and end views, respectively, of FIGS. 5 and 6, as well as in the further enlarged detail view of FIG. 7, which shown a portion of the support member. It will be understood that each of the support members 40, 38' and 40' are of similar construction.

Figure 8:
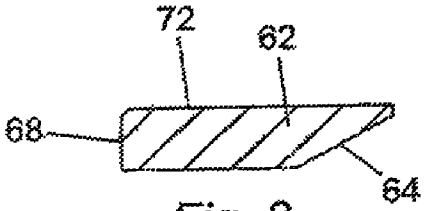
FIG. 8 is an enlarged view of an annular element forming part of the support assembly of FIGS. 1 to 3.
Figure 10:
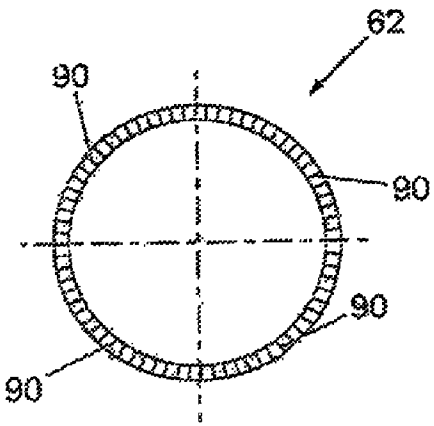
FIGS. 9 and 10 are enlarged side and end views, respectively, of the annular element shown in FIG. 8.
Figure 9:
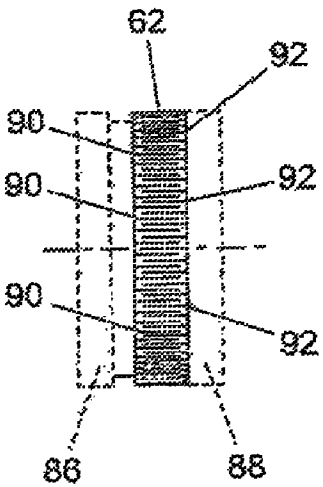
Figure 11:
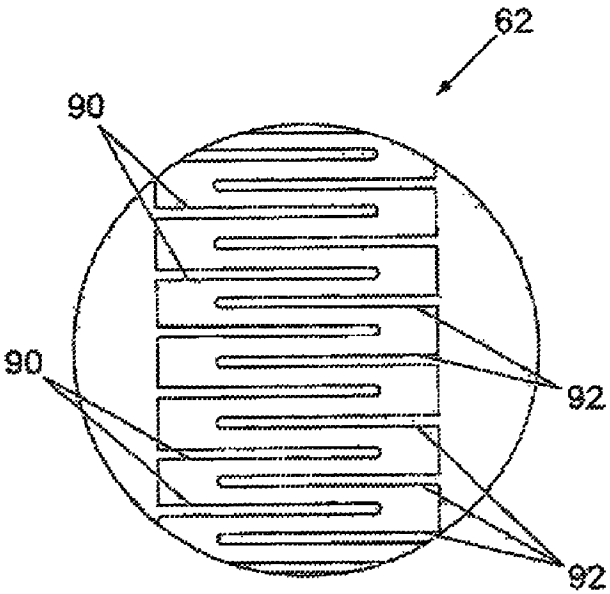
FIG. 11 is a further enlarged view of part of the annular element shown in FIG. 9.

The annular element 62 is also shown in more detail in the further enlarged sectional view of FIG. 8, the enlarged side and end views of FIGS. 9 and 10, and the further enlarged detail view of FIG. 11. Again, it will be understood that the annular element 62' is of similar construction to the element 62.

Each of the support members 38 and 40 are seated on the annular element 62, whilst the support members 38' and 40' are seated on the annular element 62'. As best shown in FIG. 8, the annular element 62 comprises an inclined surface 64, which is located in abutment with and cooperates with the inclined guide surface 48 of the guide member 46. The annular element 62 is located in a recess 66 of the actuating sleeve 42, and has an end face 68 which abuts a surface 70 of the sleeve 42. The support members 38 and 40 are seated on an outer surface 72 of the annular element 62, and are thus located relative to the guide member 46. As the support members 38, 40 and the annular element 62 are each elastically deformable, in the absence of an expansion force applied to the sealing element 14, the support members 38, 40 and the annular element 62 are in the position shown in FIG. 2.

When the expansion force is applied, the actuating sleeve 42 acts upon the annular element 62, translating it relative to the main mandrel 52. Cooperation between the inclined surfaces 64 and 48 moves the annular element 62 radially outwardly as it translates along the mandrel 52, thereby carrying the support members 38 and 40 radially outwardly. Simultaneously, the sleeves 42 and 44 compress the sealing element 14 so that it expands radially outwardly as the support members 38, 40 move out. Thus the sealing element 14 is supported during and following exertion of the expansion force.

When the expansion force is removed, by exerting a pull force on the packer 10 through the production tubing 22, the actuating sleeve 42 is translated uphole relative to the mandrel 52, releasing the expansion force on the sealing element 14. Elastic recovery of the sealing element 14 acts to extend the element axially towards the FIG. 2 position, retracting the sealing element from sealing abutment with the casing wall 28. During this movement the annular element 62 returns along the inclined guide surface 48, and the support members 38 and 40 are thus moved back towards their starting position, through elastic recovery. The production tubing 22 carrying the packer 10 can then be recovered to surface.

Figure 7:
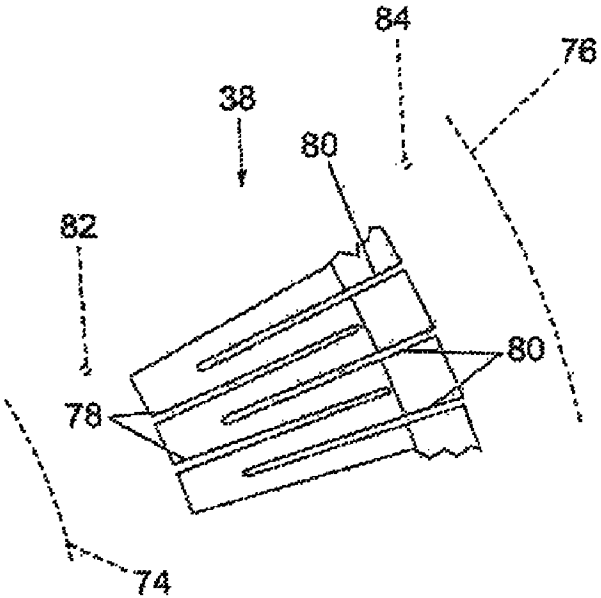
FIG. 7 is a further enlarged view of part of the support member of FIG. 6.

The support member 38 is constructed from an annular ring of a metal such as a steel, inner and outer edges of the ring indicated in broken outline in FIG. 7 by the reference numerals 74 and 76. As best shown in FIG. 7, a number of radial slots are laser cut in the annular ring, and these include a number of inner slots 78, and a number of outer slots 80. The inner and outer slots 78, 80 are spaced alternately around a circumference of the annular ring and, following cutting of the slots, border regions 82 and 84 of the ring, which facilitated handling during cutting of the slots, are cut away.

In use and during exertion of an expansion load on the sealing element 14, a circumferential width of the slots 78 and 80 increases as the support member 38 travels along the inclined guide surface 48, thereby permitting a circumferential expansion of the support member, which facilitates the desired radial movement to the position shown in FIG. 2. An edge portion 85 of the support member 38 is tapered in order to assist in retraction of the support member radially inwardly, in the event that the support member becomes stuck in an extended position, by interaction with a formation downhole.

The support members 38 and 40 are rotationally oriented such that the slots 78, 80 in the support member 38 are misaligned with corresponding slots in the support member 40. In this fashion, the effects of mechanical loading on the support members 38 and 40 can be distributed. Furthermore, arranging the support members 38 and 40 such that these slots are misaligned helps to prevent relatively large solids particles become lodged in the slots following expansion, which could otherwise hamper retraction of the support members following removal of the expansion force.

The annular element 62 is of a similar material and manufactured in a similar fashion to the support member 38, and is shown in more detail in the views of FIGS. 9 to 11. The element 62 is constructed from a hollow cylindrical tube, end regions 86 and 88 of which are shown in FIG. 9. A number of axially extending slots 90 are laser cut and extend from the end region 86, and a number of similar slots 92 are laser cut and extend from the end region 88. As with the support member 38, the slots 90 and 92 are alternated around a circumference of the element 62, and the end regions 86 and 88 are removed after the slots have been cut. Circumferential expansion of the element 62 occurs as the element travels along the inclined guide surface 48 from the position of FIG. 2 to the position of FIG. 3, facilitated by an increase in a circumferential width of the slots 90 and 92.

The guide members 46 are provided as annular rings which are generally wedge-shaped in cross-section, to define the inclined guide surfaces 48. The guide members 46 are slidably mounted on the main mandrel 52, and are initially located within a recess 94 in the sealing element, a lip 96 of the sealing element engaging the guide member 46. When the packer 10 is actuated to translate the actuating sleeve 42 towards the fixed sleeve 44, the guide members 46 are partially received in the recess 66 in the sleeve 42, as best shown in FIG. 3.

The above-described support assembly provides an effective means for supporting the sealing element 14 both during and following expansion into sealing abutment with the casing wall 28. Furthermore, elastic recovery of the support members 38, 40 and 38' and 40' as well as the annular elements 62, 62' readily permit retraction and recovery of the packer 10 from the wellbore 16.

Figure 12:
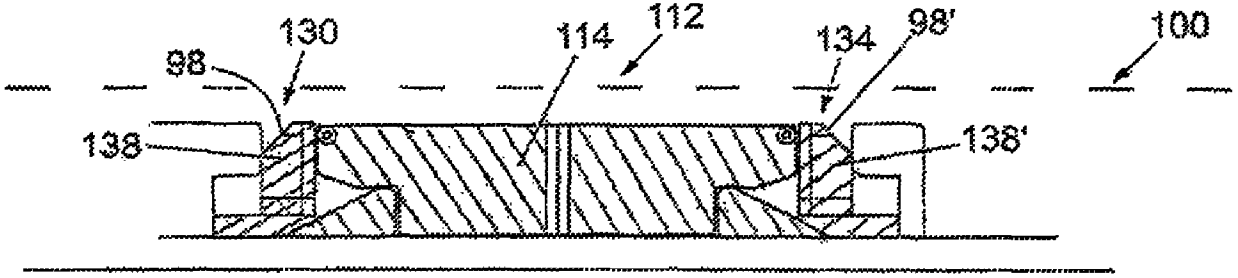
FIG. 12 is a longitudinal half-sectional view of part of a downhole tool in the form of a packer, the packer comprising a support assembly for a deformable sealing element, in accordance with an alternative embodiment of the present invention, the packer shown prior to actuation.
Figure 13:
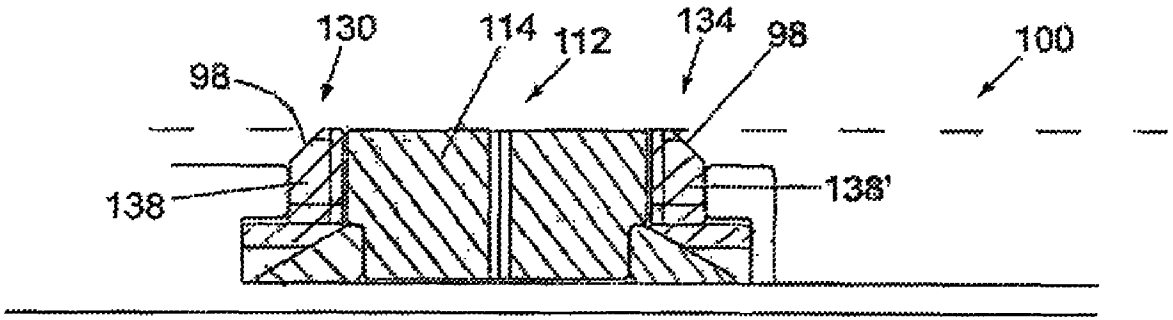
FIG. 13 is a view of part of the packer of FIG. 12 showing the support assembly following actuation of the packer.

Turning now to FIGS. 12 and 13, there are shown longitudinal half-section views of parts of a downhole tool in the form of a packer 100, incorporating a support assembly 112, in accordance with an alternative embodiment of the present invention. FIGS. 12 and 13 are similar to the views of FIGS. 2 and 3 of the packer 10 described above. Like components of the packer 100 with the packer 10 of FIGS. 1 to 11 share the same reference numerals, incremented by 100. Only the substantive differences of the packer 100 over the packer 10 will be described herein in detail.

The packer 100 is in fact identical to the packer 10, save that first and second support devices of the support assembly 112 include first support members 138, 138' of a different shape. Only the support member 138 will be described herein, however, it will be understood that the support member 138' is of similar construction.

The support member 138 is of a greater axial length than the support member 38 of the packer 10. As a result, the support member 138 has improved resistance to applied mechanical loads and thus there is less likelihood of a permanent plastic deformation of the support member 138 occurring. Furthermore, increasing the axial length of the support member 138 permits formation of a large inclined abutment surface 98, which facilitates retraction of the support member 138 in the event that it becomes stuck in the extended position of FIG. 13, through interaction with a formation downhole. Finally, the larger axial length support member 138 provides enhanced support to a sealing element 114 of the packer 100.

Figure 14:
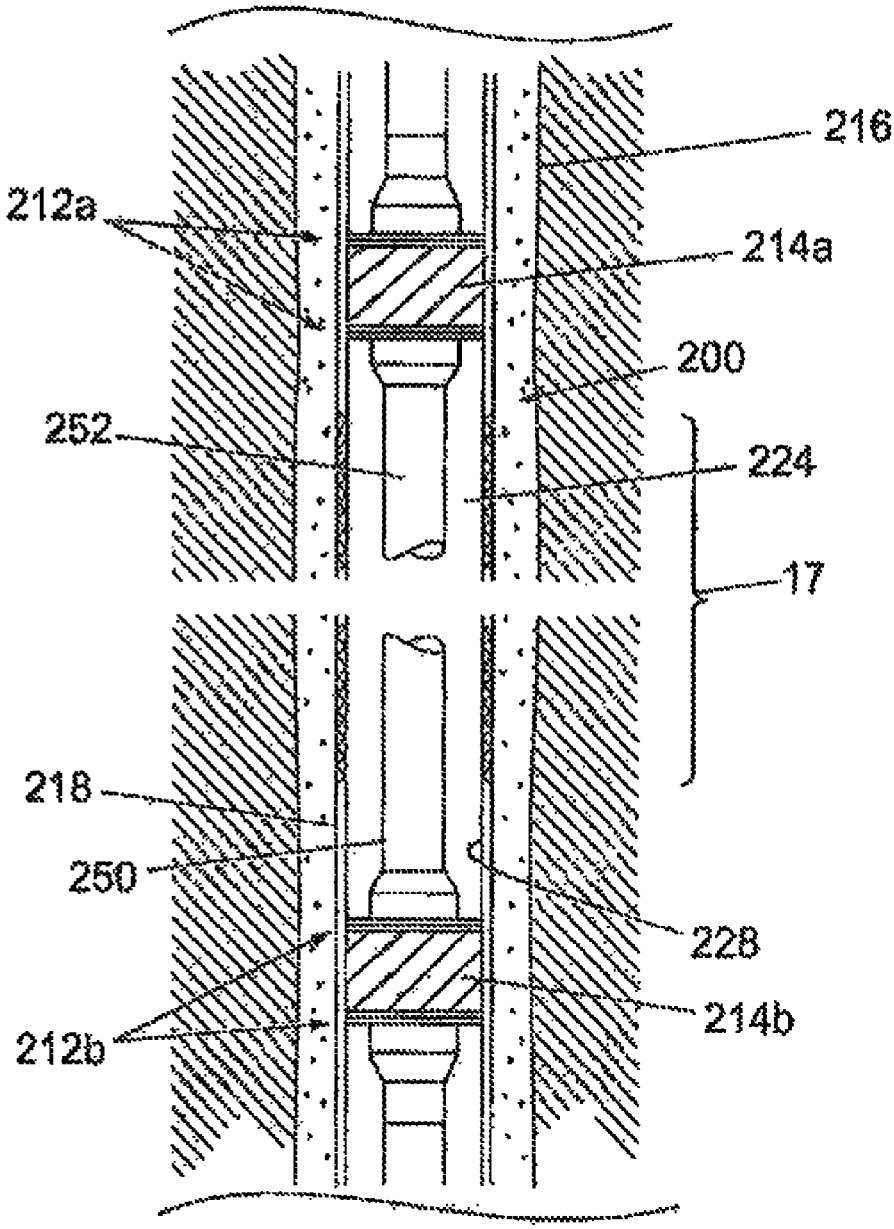
FIG. 14 is a schematic, partial longitudinal sectional view of a downhole tool in the form of a straddle, in accordance with an alternative embodiment of the present invention.

Turning finally to FIG. 14, there is shown a schematic, partial longitudinal sectional view of a downhole tool in the form of a straddle 200, in accordance with an alternative embodiment of the present invention. Like components of the straddle 200 with the packer 10 of FIGS. 1 to 11 share the same reference numerals, incremented by 200. Only the substantial differences between the straddle 200 and the packer 10 will be described herein in detail.

The straddle 200 comprises two support assemblies 212*a*, 212*b* for respective deformable sealing elements 214*a*, 214*b*, connected by a main mandrel or tube 252. The support assemblies 212*a*, 212*b* are each of like construction and operation to the support assembly 12 of FIGS. 1 to 11. However, it will readily be understood that the straddle 200 may comprise support assemblies 212*a*, 212*b* of like construction and operation to the support assembly 112 of FIGS. 12 and 13.

The straddle 200 is utilised, for example, when it is desired to isolate a portion of a cased or lined wellbore and, in the illustrated embodiment, is utilised to isolate a portion 17 of a casing 218 which has become corroded, resulting in undesired fluid ingress into wellbore 216 from surrounding rock formations. The straddle 200 is run-in to the casing 218 on a tubing string (not shown), and is located straddling across the corroded portion 17 so that the sealing element 214*a* is located uphole of the corroded portion 17, and the sealing element 214*b* downhole of the corroded portion 17. The straddle 200 is then actuated, in a known fashion, to exert axial compression forces on the sealing elements 214*a*, 214*b*, to expand them radially outwardly into sealing abutment with undamaged areas of an inner wall 228 of the casing 218. Indeed, the straddle 200 is shown in FIG. 14 following such expansion of the sealing elements 214*a*, 214*b*.

In this fashion, a portion of an annulus 224 defined between an outer surface 250 of the straddle 200 and the inner casing wall 228 is isolated, preventing the passage uphole of fluids which have entered the annulus 224 through the corroded portion 17. The tubing string used to run the straddle 200 into the wellbore 216 is then detached and retrieved to surface, and wellbore operations may proceed as before, with access downhole and fluid flow permitted through a main mandrel 252 of the straddle 200. It will be understood that the support assemblies 212*a*, 212*b* function as described above in relation to the assembly 12 of the packer 10, and that the sealing elements 214*a*, 214 are expanded in a similar fashion to the sealing element 14 of the packer 10.

In a further embodiment of the present invention (not shown), a bridge plug incorporating a sealing assembly similar to the assembly 12 of the packer 10; the assemblies 212*a*, 212*b* of the straddle 200; or the assembly 112, may be provided.

Various modifications may be made to the foregoing without departing from the spirit and scope of the present invention.

For example, it will be understood that the principles of the present invention are applicable to a wide range of types of downhole tool requiring or incorporating a deformable sealing element, including other types of packers. Indeed, the present invention has a potential utility outwith the field of downhole tools, and thus in further aspects of the invention, alternative tools may be provided having the features of the downhole tool defined above. For example, tools to be used in pipelines or other flowlines may be provided having the features of the downhole tool defined above.

Where the support devices optionally include further support members, the further support members may be located between the support members which are located in abutment with the sealing element and the actuating member, respectively.

Optionally, both of the actuating members are mounted for movement relative to a main body of the tool, for exerting an expansion force on the sealing element. The actuating members may take the form of pistons and thus may be fluid actuated, or may be mechanically or electro-mechanically actuated members.

The support members may each be adapted to be located in sliding contact/abutment with the guide surfaces of the respective guide members, and may comprise inclined surfaces adapted to cooperate with the inclined guide surfaces of the guide members, to facilitate passage of the support members along and thus relative to the guide members.

The invention claimed is:

1. A support assembly for a deformable sealing element of a downhole tool, the support assembly comprising: a first support device adapted to be located adjacent a first end of a deformable sealing element of a downhole tool; and a second support device adapted to be located adjacent a second end of the sealing element; wherein the first and second support devices each comprise at least one elastically deformable support member adapted to be located between the respective end of the sealing element and an actuating member of the downhole tool; and a guide member having an inclined guide surface along which the support member travels when a force is exerted on the support member by the respective actuating member thereby axially compressing the sealing element to expand the sealing element radially into abutment with a surface downhole, the guide member acting to move the support member axially with the sealing element and to stretch the support member radially outwardly in substantially only the plane of the support member to thereby axially support the respective end of the sealing element during deformation; wherein the support members and the sealing element are each expandable on exertion of a force via the actuating member and each are retractable on removal of the force.

2. A support assembly as claimed in claim 1 wherein each support member is adapted to travel back along the inclined guide surface of the guide member when the force acting on the sealing element is removed, so that the support member returns radially inwardly.

3. A support assembly as claimed in claim 1 wherein the support members are each expandable on exertion of the force on the sealing element, such that at least one dimension of the support devices increases.

4. A support assembly as claimed in claim 1 wherein the support devices each further comprise an elastically deformable force transmission element for the respective support member, the support member adapted to be located in abutment with the force transmission element, and the force transmission element adapted to be located in sliding contact with the inclined guide surface of the respective guide member.

5. A support assembly as claimed in claim 4 wherein the force transmission elements each comprise abutment surfaces for abutment with the support member, and inclined surfaces adapted to cooperate with the inclined guide surfaces of the guide members, to facilitate passage of the support members along and thus relative to the guide member.

6. A support assembly as claimed in claim 1 wherein the support members are each adapted to be located in sliding contact with the guide surfaces of the respective guide members, and comprise inclined surfaces adapted to cooperate with the inclined guide surfaces of the guide members, to facilitate passage of the support members along and thus relative to the guide members.

7. A support assembly as claimed in claim 1 wherein the support members are generally annular members having inner and outer surfaces describing respective inner and outer diameters of the support members, and the support members are configured such that cooperation with the respective guide members results in an increase in both the inner and outer diameters of the support members.

8. A support assembly as claimed in claim 7 wherein the support members each take the form of a sprung member comprising a plurality of slots.

9. A support assembly as claimed in claim 8 wherein the slots extend through the support members in an axial direction and part way along the support member in a radial direction.

10. A support assembly as claimed in claim 8 wherein the slots are configured such that at least one dimension of the slots increases on exertion of the force on the sealing element, to facilitate the radial movement of the support member to thereby support the sealing element.

11. A support assembly as claimed in claim 4 wherein the force transmission elements are generally annular members having inner and outer surfaces describing respective inner and outer diameters of the force transmission elements, and the force transmission elements are configured such that cooperation with the respective guide members results in an increase in both the inner and outer diameters of the force transmission elements.

12. A support assembly as claimed in claim 11 wherein the force transmission elements each take the form of a sprung member comprising a plurality of slots extending through a wall thereof.

13. A support assembly as claimed in claim 12 wherein the slots extend through the force transmission elements in a radial direction and part way along the support member in an axial direction.

14. A support assembly as claimed in claim 12 wherein the slots are configured such that at least one dimension of the slots increases on exertion of the force on the sealing element, to facilitate the radial movement of the force transmission elements to carry the support members radially outwardly.

15. A downhole tool comprising: a deformable sealing element adapted to be expanded radially into abutment with a surface downhole; a first actuating member located adjacent a first end of the sealing element; a second actuating member located adjacent a second end of the sealing element; a first support device located adjacent the first end of the sealing element; and a second support device located adjacent the second end of the sealing element; wherein the first and second support devices each comprise at least one elastically deformable support member located between the respective end of the sealing element and the respective actuating member; and a guide member having an inclined guide surface along which the support member travels when a force is exerted on the support member by the respective actuating member thereby axially compressing the sealing element to expand the sealing element radially into abutment with a surface downhole, the guide member acting to stretch the support member radially outwardly in substantially only the plane of the support member to thereby axially support the respective end of the sealing element during deformation; wherein the support members and the sealing element are each expandable on exertion of a force via the actuating member and each are retractable on removal of the force.

16. A downhole tool as claimed in claim 15 wherein the downhole tool is a packer.

17. A downhole tool as claimed in claim 15 wherein the downhole tool is abridge plug.

18. A downhole tool as claimed in claim 15 wherein the downhole tool is a straddle.

19. A method of supporting a deformable sealing element of a downhole tool during radial expansion into abutment with a surface downhole, the method comprising the steps of: mounting a first support device adjacent a first end of a deformable sealing element on a downhole tool; mounting a second support device adjacent a second end of the sealing element; exerting a force on the sealing element using a first actuating member located adjacent the first end of the sealing element and a second actuating element located adjacent the second end of the sealing element, to axially compress the sealing element to radially expand the sealing element into abutment with a surface downhole; and transmitting the force exerted on the sealing element by the first and second actuating members through respective first and second support devices located adjacent the respective first and second ends of the sealing element, to cause elastically deformable support members of each support device to travel along inclined guide surfaces of respective guide members of the devices such that the support members move radially outwardly in substantially only the plane of the support member to thereby axially support the respective ends of the sealing element during deformation; wherein the support members and the sealing element are each expandable on exertion of a force via the actuating member and each are retractable on removal of the force.

* * * * *